United States Patent [19]

Tschudi

[11] 4,332,490

[45] Jun. 1, 1982

[54] LINING-UP ASSEMBLY FOR A PRINTING DISC

[75] Inventor: Giulio Tschudi, Yverdon, Switzerland

[73] Assignee: Hermes Precisa International S.A., Yverdon, Switzerland

[21] Appl. No.: 160,592

[22] Filed: Jun. 18, 1980

[30] Foreign Application Priority Data

Jul. 3, 1979 [CH] Switzerland ..... 6184/79

[51] Int. Cl.[3] ..... B41J 1/26; B65D 85/02; B41J 29/16

[52] U.S. Cl. ..... 400/175; 206/303; 400/144.2; 400/692; 400/717

[58] Field of Search ..... 206/444, 303, 309, 387; 400/144.2, 144.3, 175, 149, 171, 691, 692, 717

[56] References Cited

U.S. PATENT DOCUMENTS

| | | | |
|---|---|---|---|
| 3,907,116 | 9/1975 | Wolf et al. | 206/387 X |
| 3,924,724 | 12/1975 | Kerzel | 400/175 |
| 4,127,335 | 11/1978 | Bogert et al. | 400/144.2 |

OTHER PUBLICATIONS

*IBM Tech. Disc. Bulletin*, by R. E. Griffith, vol. 22, No. 1, Jun. 1979, p. 205.

*Primary Examiner*—Paul T. Sewell
*Attorney, Agent, or Firm*—Emory L. Groff, Jr.

[57] ABSTRACT

A lining-up assembly for a "daisy printer" or printing disc having a hub presenting radial arms whose free ends are provided with relief characters, wherein the assembly comprises a casing in which at least one movable drawer is slidable. So as to avoid any manual contact by the user with the printing disc, this assembly also comprises tongs for locating or securing the hub of the disc to the drawer; said tong constituting a manipulating tool for the printing disc.

5 Claims, 2 Drawing Figures

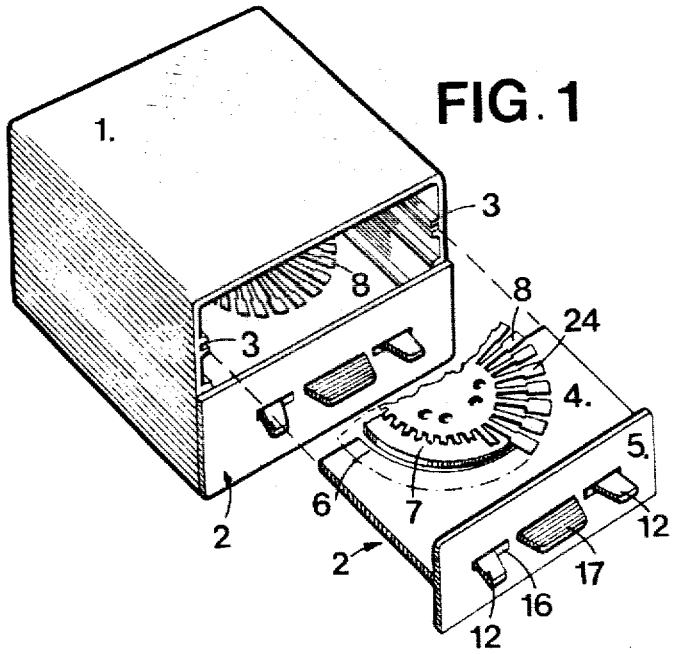
FIG. 1
FIG 2
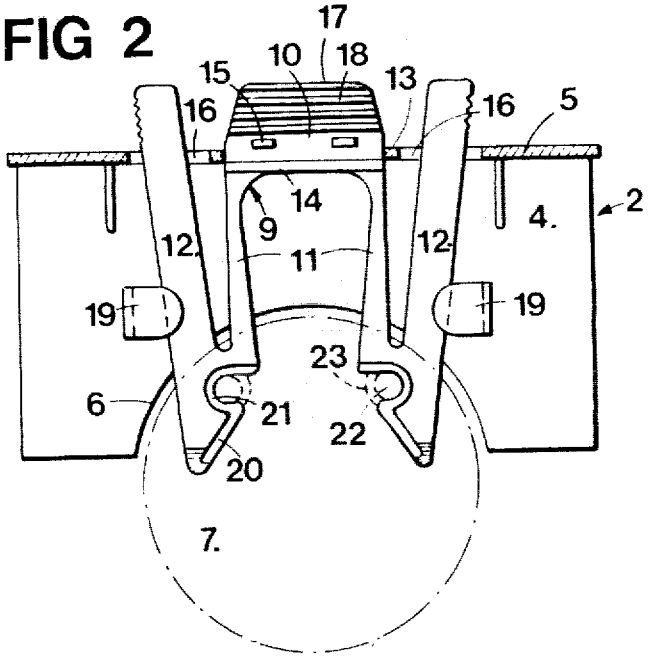

LINING-UP ASSEMBLY FOR A PRINTING DISC

The present invention concerns a setting-up or lining-up assembly for so called "daisy printers" or printing discs, constituted by a hub presenting radial arms the free ends of which are provided with relief characters, and wherein the assembly comprises a casing in which at least one movable drawer slides.

Printing discs are very fragile members where the slightest deformation can render them useless. Moreover, because of the problems of storage and of transportation which result from this fragility, the users of disc typewriters hesitate to change a printing disc themselves - being frightened of damaging it by an error in manipulation.

The object of the invention is to provide a lining-up assembly for a printing disc permitting the avoidance of all direct manipulation of the printing disc and also ensuring the protection of the disc during its transportation or storage.

According to the present invention there is provided a lining-up assembly for printing discs having a hub presenting radial arms, the free ends of which are provided with relief characters, said assembly comprising a casing in which at least one movable drawer slides, and means provided for securing the hub to the drawer and constituting a manipulating tool for handling the printing disc.

The invention will be described further, schematically and by way of example, showing one embodiment, and in which:

FIG. 1 is a perspective view of a lining-up assembly; and

FIG. 2 is a section on an enlarged scale showing a drawer and securing member.

With reference to the drawing, the lining-up assembly comprises a casing 1 open on one of its faces and in which two drawers 2 are slidable along guides 3 formed integral with the casing 1.

Each drawer 2 is constituted by a platform or plate 4 secured to a front plate 5 corresponding to a portion of the open face of the casing 1. The front plate 5 has an outer face and an inner face and the plate 4 extends from the inner face at substantially a right angle thereto and is slidable in the guides 3. The plate 4 has a cut-out 6 in the form of a circular segment whose edge is adapted to partially surround the periphery of a hub 7 of a "daisy printer" or printing disc 8. This hub has radial arms 24 whose free ends are provided with relief characters (not shown). Tongs 9, constituting means for securing the hub 7 to the drawer 2, are fixed to the plate 4 and extend parallel to said plate 4.

The tongs 9 are constituted by a central body 10 presenting two flexible branches 11 extending beyond the edge of the cut-out 6 and the free ends of the branches are integral with arms 12 extending on each side of the central body 10. This central body 10 and the ends of the arms 12 traverse the front plate 5 via slots 13 and 16. The central body 10 is positioned in the middle slot 13 and is locked in position by a shoulder 14 and retaining projections 15 bearing on each side of the front plate 5. The arms 12 pass through extended lateral slots 16, so that they can be brought closer together by the user.

The portion of the central body 10 passing through the front plate 5 forms a handle 17 and presents ridges 18 so as to facilitate the gripping thereof. The tongs 9 are maintained against the lower face of the plate 4 by two turned-in feet 19 secured to the plate 4. The free ends of the flexible branches 11 present guide ramps 20, opposite each other and converging into retaining notches 21. The ramps 20 and the retaining notches 21 are adapted to co-operate with gripping pivots or pins 22 of the hub 7 of the printing disc 8, said pins 22 presenting annular throats 23 engaging in the notches 21.

The lining-up assembly described above ensures a good protection of the printing discs. In fact, when the hub 7 is secured to the plate 4 of the drawer 2, the radial arms 24 of the printing disc 8 carrying the relief characters are not in contact with the drawer. The lining-up assembly can be overturned without the printing disc being displaced with respect to the casing 1. The tongs securing the hub 7 to the drawer 2 constitute a manipulative tool for the printing disc and permits the user to avoid manual contact with the disc.

To arrange the printing disc 8 in a typewriter, at the end of the driving shaft, there is sorted out a drawer 2 of the casing 1 carrying the desired disc and this disc is held in place by the tongs 9 of the handle 17. When the disc is secured in the typewriter, the ends of the arms 12 are pinched so that the free ends of the flexible branches 11 move away from each other and free the gripping pins 22 from the support 7.

To resecure a printing disc 8 in the drawer 2, it suffices to place the tongs 9 against the disc 8 and to bear radially in the direction of the axis of the hub of the disc. The pins 22 co-operate with the ramps 20 and force the flexible branches 11 away from each other until the pins 22 fall into the notches 21. The arrangement of the tongs 9 is advantageous, as it permits the holding of the printing disc 8 by the handle 17 without acting on the flexible branches 11.

This lining-up assembly is particularly intended for "daisy wheel printers" or printing discs comprising a hub 7 provided with means for assembly on a drive shaft which slides parallel to the plane of the hub 7 and radially with respect to the axis of the driving shaft. In this case, the printing mechanism, of which the driving shaft forms a part, is advantageously provided with guides for the drawer 2, so as to facilitate the emplacement of the disc.

Numerous variations can be envisaged of embodiments of the assembly forming the subject of the invention.

The drawers 2 could be provided with means for bolting such to the casing 1 to maintain it in place when they are fully engaged in said casing. These retaining or locking means could be constituted, for example, by an elastic projection extending from the plate 4 elastically engaging in a hollow in the guides 3 or by any form of lock having an elastic notch.

The casing 1 could contain a single printing disc in one embodiment more especially adapted to ensure the protection of the disc 8 during its transport or storage. A lining-up assembly could be conceived presenting more than two drawers, this assembly being adapted, for example, to the lining-up of a set of several discs carrying printing characters of different types of writing.

A lining-up assembly could be conceived in which the tongs 9 can be detached from the plate 4 of the drawer 2 with the printing disc 8. The tongs 9 are then provided with assembly means to the plate 4 of the drawer 2.—these means ensuring the immobility of the disc 8 with respect to the plate 4 when it is lined-up in the drawer 2.

I claim:

1. A lining-up assembly for a printing disc for use in a typewriter, said disc including a hub, radial arms on said hub, the free ends of said arms provided with relief characters, said assembly comprising a casing, guides in said casing, at least one movable drawer slidable in said guides, means for securing the hub to the drawer, said means comprising a manipulating tool for handling the printing disc, said drawer comprising a front plate and a support plate slidable in said guides of said casing, said support plate having a cut-out area in the form of a circular segment, the edge of which surrounds said hub on a portion of its periphery, said manipulating tool attached to the support plate and releasably secured to said hub to permit securing the hub to the drawer and for handling the disc when it is connected to and disconnected from said typewriter.

2. An assembly as claimed in claim 1, in which the securing means comprises tongs extending parallel to the plane of the plate and extending beyond the edge of the cut-out to co-operate with gripping members secured to the hub.

3. An assembly as claimed in claim 2, in which the tongs comprise a central body securable to the drawer and presenting two flexible branches whose free ends extend beyond the edge of the cut-out and include two arms integral with the free ends of the flexible branches extending on each side of the central body.

4. An assembly as claimed in claim 3, in which the ends of the flexible branches include ramps inclined away from each other in the direction of the end of the tongs, pins on the hub, said ramps converging into retaining notches cooperating with said pins.

5. A lining-up assembly for printing discs including a hub, radial arms on said hub, the free ends of said arms provided with relief characters, said assembly comprising a casing, guides in said casing, at least one movable drawer slidable in said guides, said drawer comprising a plate slidable in said guides of said casing, said plate having a cut-out in the form of a circular segment, the edge of which surrounds said hub on a portion of its periphery, means securing the hub to the drawer, said means comprising a manipulating tool for the printing disc, said tool secured to said drawer and comprising tongs extending parallel to the plane of said plate, said tongs comprising a central body securable to said drawer and including two flexible branches whose free ends extend beyond the edge of said cut-out, two arms integral with the free ends of the flexible branches extending on each side of said central body, gripping members secured to said hub, said gripping members engageable by the free ends of said branches, said drawer including a front plate disposed perpendicular to the plane of said first mentioned plate, said front plate having a middle slot and side slots adjacent said middle slot, a portion of said central body extending through said middle slot and forming a handle, the ends of said arms extending on each side of the central body passing through said side slots in the front plate such that, in use, the arms can be brought closer together.

* * * * *